US010256610B2

(12) United States Patent
Ozeki et al.

(10) Patent No.: US 10,256,610 B2
(45) Date of Patent: Apr. 9, 2019

(54) SPARK PLUG

(71) Applicant: NGK SPARK PLUG CO., LTD., Nagoya-shi, Aichi (JP)

(72) Inventors: Keiji Ozeki, Konan (JP); Tsutomu Kobayashi, Inazawa (JP)

(73) Assignee: NGK Spark Plug Co., Ltd., Nagoya-shi, Aichi (JP)

( * ) Notice: Subject to any disclaimer, the term of this patent is extended or adjusted under 35 U.S.C. 154(b) by 0 days.

(21) Appl. No.: 16/060,784

(22) PCT Filed: Aug. 5, 2016

(86) PCT No.: PCT/JP2016/003618
§ 371 (c)(1),
(2) Date: Jun. 8, 2018

(87) PCT Pub. No.: WO2017/098674
PCT Pub. Date: Jun. 15, 2017

(65) Prior Publication Data

US 2018/0366917 A1 Dec. 20, 2018

(30) Foreign Application Priority Data

Dec. 11, 2015 (JP) ..... 2015-241921

(51) Int. Cl.
*H01T 13/20* (2006.01)
*H01T 13/34* (2006.01)
*H01T 13/36* (2006.01)

(52) U.S. Cl.
CPC ..... *H01T 13/36* (2013.01); *H01T 13/20* (2013.01); *H01T 13/34* (2013.01)

(58) Field of Classification Search
CPC ..... H01T 13/20; H01T 13/34; H01T 13/36
See application file for complete search history.

(56) References Cited

U.S. PATENT DOCUMENTS 6,373,173 B1 * 4/2002 Suzuki ..... H01T 13/20 313/135
10,027,093 B2 * 7/2018 Kobayashi ..... H01T 13/20
(Continued)

FOREIGN PATENT DOCUMENTS

EP 3291388 A1 3/2018
JP 2012-129042 7/2012
(Continued)

OTHER PUBLICATIONS

International Search Report from corresponding International Patent Application No. PCT/JP16/03618, dated Oct. 23, 2016.

*Primary Examiner* — Mariceli Santiago
(74) *Attorney, Agent, or Firm* — Kusner & Jaffe

(57) ABSTRACT

A spark plug includes a tubular metal shell that includes a metal-shell step portion extending in an inner circumferential direction, an insulator that is inserted in the metal shell, that includes a facing portion that faces the metal-shell step portion with an annular packing interposed therebetween, a center electrode that extends in the axial direction, that has a flange portion extending in an outer circumferential direction, and a seal body seals the insulator and the center electrode. In a section that contains the axial line and that is along the axial line, a distance L along the axial line from a rear end of the facing portion of the insulator to a rear end of a portion at which the flange portion is in contact with the insulator satisfies L≤1.1 (mm).

5 Claims, 9 Drawing Sheets

(56) References Cited

U.S. PATENT DOCUMENTS

| | | | | |
|---|---|---|---|---|
| 2010/0133978 | A1* | 6/2010 | Ishida | H01T 13/20 313/141 |
| 2011/0241523 | A1* | 10/2011 | Kameda | H01T 13/39 313/141 |
| 2012/0153799 | A1* | 6/2012 | Kameda | H01T 13/50 313/141 |
| 2013/0134857 | A1* | 5/2013 | Shimamura | H01T 13/16 313/135 |
| 2015/0108892 | A1 | 4/2015 | Shibata | |

FOREIGN PATENT DOCUMENTS

| | | |
|---|---|---|
| JP | 2015-082355 | 4/2015 |
| JP | 2015-185286 | 10/2015 |
| JP | 2016-004748 | 1/2016 |
| JP | 2016-207585 | 12/2016 |

* cited by examiner

FIG. 3

| SAMPLE NAME | Rc(mm) | Rs(mm) | L(mm) | GAP GROWTH AMOUNT (mm) | RATE OF CHANGE (%) | DECISION |
|---|---|---|---|---|---|---|
| 1 | 2.3 | 3.9 | 1.8 | 0.227 | 0.00 | — |
| 2 | 2.3 | 3.9 | 1.4 | 0.220 | −3.08 | × |
| 3 | 2.3 | 3.9 | 1.1 | 0.214 | −5.73 | ○ |
| 4 | 2.3 | 3.9 | 0.9 | 0.210 | −7.49 | ○ |
| 5 | 2.3 | 3.9 | 0.7 | 0.206 | −9.25 | ○ |
| 6 | 2.3 | 3.9 | 0.5 | 0.203 | −10.57 | ○ |
| 7 | 2.3 | 3.9 | 0.4 | 0.201 | −11.45 | ○ |
| 8 | 2.3 | 3.0 | 1.8 | 0.162 | 0.00 | — |
| 9 | 2.3 | 3.0 | 1.4 | 0.156 | −3.70 | × |
| 10 | 2.3 | 3.0 | 1.1 | 0.151 | −6.79 | ○ |
| 11 | 2.3 | 3.0 | 0.9 | 0.147 | −9.26 | ○ |
| 12 | 2.3 | 3.0 | 0.7 | 0.144 | −11.11 | ○ |
| 13 | 2.3 | 3.0 | 0.5 | 0.141 | −12.96 | ○ |
| 14 | 2.3 | 3.0 | 0.4 | 0.139 | −14.20 | ○ |
| 15 | 1.9 | 3.9 | 1.8 | 0.200 | 0.00 | — |
| 16 | 1.9 | 3.9 | 1.4 | 0.193 | −3.50 | × |
| 17 | 1.9 | 3.9 | 1.1 | 0.187 | −6.50 | ○ |
| 18 | 1.9 | 3.9 | 0.9 | 0.183 | −8.50 | ○ |
| 19 | 1.9 | 3.9 | 0.7 | 0.179 | −10.50 | ○ |
| 20 | 1.9 | 3.9 | 0.5 | 0.175 | −12.50 | ○ |
| 21 | 1.9 | 3.9 | 0.4 | 0.174 | −13.00 | ○ |

$$C = \frac{2\pi\varepsilon_0 L}{\log\left(\frac{b}{a}\right)}$$

FIG. 9

| SAMPLE NAME | L(mm) | θA(°) | θB(°) | (θA+θB)(°) | DECISION |
|---|---|---|---|---|---|
| 22 | 0.6 | 30 | 43 | 73 | ○ |
| 23 | 0.6 | 45 | 43 | 88 | ○ |
| 24 | 0.6 | 50 | 43 | 93 | ○ |
| 25 | 0.6 | 60 | 43 | 103 | ○ |
| 26 | 0.6 | 63 | 43 | 106 | ○ |
| 27 | 0.6 | 70 | 43 | 113 | ○ |
| 28 | 0.6 | 75 | 43 | 118 | ○ |
| 29 | 0.5 | 30 | 40 | 70 | × |
| 30 | 0.5 | 45 | 40 | 85 | × |
| 31 | 0.5 | 50 | 40 | 90 | ○ |
| 32 | 0.5 | 60 | 40 | 100 | ○ |
| 33 | 0.5 | 63 | 40 | 103 | ○ |
| 34 | 0.5 | 70 | 40 | 110 | ○ |
| 35 | 0.5 | 75 | 40 | 115 | ○ |
| 36 | 0.4 | 30 | 37 | 67 | × |
| 37 | 0.4 | 45 | 37 | 82 | × |
| 38 | 0.4 | 50 | 37 | 87 | × |
| 39 | 0.4 | 60 | 37 | 97 | × |
| 40 | 0.4 | 63 | 37 | 100 | ○ |
| 41 | 0.4 | 70 | 37 | 107 | ○ |
| 42 | 0.4 | 75 | 37 | 112 | ○ |

SPARK PLUG

RELATED APPLICATIONS

This application is a National Stage of International Application No. PCT/JP16/03618 filed Aug. 5, 2016, which claims the benefit of Japanese Patent Application No. 2015-241921, filed. Dec. 11, 2015, the entire contents of which are incorporated herein by reference.

FIELD OF THE INVENTION

The present invention relates to a spark plug.

BACKGROUND OF THE INVENTION

In recent years, the pressure in vehicle engines during combustion tends to increase because of an increased output and improved fuel economy of the engines. Consequently, the required voltage of spark plugs installed in the engines tends to increase during ignition. The higher the required voltage of the spark plugs during ignition, the more easily electrodes of the spark plugs erode.

In a conventional technique to reduce the erosion of electrodes of a spark plug, an end of a core material of a center electrode is coated with a material having a thermal expansion coefficient lower than that of the core material (see Japanese Unexamined Patent Application Publication No. 2015-82355).

However, since such a spark plug uses a material with which the core material of the center electrode is coated, the manufacturing cost of the spark plug increases in some cases. For this reason, there is a need for a technique that enables the erosion of the electrodes to be reduced regardless of the material of the electrodes.

The present invention has been accomplished to address the above problem and can be achieved as the following aspects.

SUMMARY OF THE INVENTION (1) In accordance with a first aspect of the present invention, there is provided a spark plug having a tubular metal shell that includes a metal-shell step portion extending in an inner circumferential direction and that has a tubular hole extending in an axial direction, an insulator that is inserted in the metal shell, that has an axial hole extending in the axial direction, and that includes a facing portion that faces the metal-shell step portion with an annular packing interposed therebetween, a center electrode that extends in the axial direction, that has a flange portion extending in an outer circumferential direction, and that is inserted in the axial hole, and a seal body that is disposed in the axial hole and that seals the insulator and the center electrode. In a section that contains the axial line and that is along the axial line, a distance L along the axial line from a rear end of the facing portion of the insulator to a rear end of a portion at which the flange portion is in contact with the insulator satisfies $L \leq 1.1$ (mm). The spark plug according to the first aspect enables the electrostatic capacity of a region of the spark plug having the distance L to be decreased in a manner in which the distance L is 1.1 mm or less, and hence enables the erosion of the electrodes of the spark plug to be reduced.

(2) In accordance with a second aspect of the present invention, there is provided a spark plug as described above, wherein $\theta A+\theta B \geq 90°$ and L 0.5 (mm) may hold, where θA represents an acute angle formed between a reference line perpendicular to the axial line and the portion at which the flange portion is in contact with the insulator in the section, and θB represents an acute angle formed between the reference line and a straight line connecting a front end of the facing portion and the rear end of the portion at which the flange portion is in contact with the insulator. The spark plug according to this second aspect enables the electrostatic capacity to be decreased and enables a sufficient strength of the insulator to be ensured.

(3) In accordance with a third aspect of the present invention, there is provided a spark plug as described above, wherein a nominal diameter M of a screw portion of the metal shell may satisfy $M \leq 12$ (mm). The spark plug according to this third aspect enables the electrostatic capacity of the spark plug, in which the nominal diameter M is 12 or less, to be decreased to reduce the erosion of the electrodes.

The present invention can be achieved as various aspects other than the above aspects of the spark plug, for example, a method of manufacturing a spark plug.

BRIEF DESCRIPTION OF DRAWINGS

FIG. 3 illustrates the relationship between a distance L and a rate of change in a gap growth amount.

FIG. 9 illustrates the relationship among the distance L, the value of (θA+θB), and the strength of an insulator.

DETAILED DESCRIPTION OF THE INVENTION

A. First Embodiment: A1. Structure of Spark Plug

Figure 1:
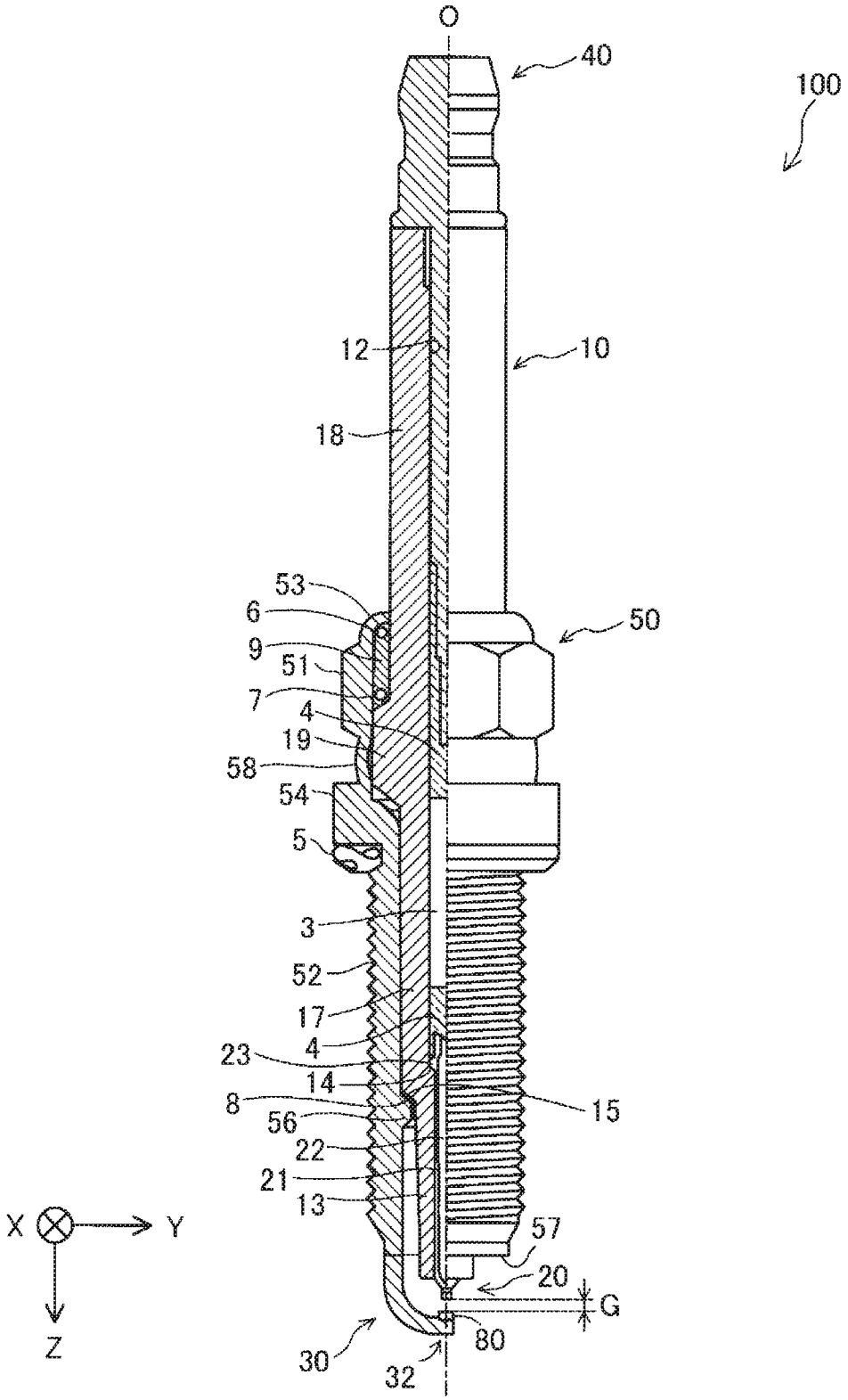
FIG. 1 is a partial sectional view of a spark plug according to a first embodiment of the present invention.

FIG. 1 is a partial sectional view of a spark plug 100 according to a first embodiment of the present invention. The spark plug 100 has an elongated shape along an axial line O. In FIG. 1, an external appearance is illustrated on the right-hand side of the axial line O illustrated by a one-dot chain line, and a section along the axial line O is illustrated on the left-side of the axial line O. In the following description, a lower side in FIG. 1 is referred to as a front-end side of the spark plug 100, and an upper side in FIG. 1 is referred to as a rear-end side. The XYZ-axes in FIG. 1 correspond to the XYZ-axes in the other figures. The axial line O and the Z-axis are parallel to each other, and a +Z-direction is the axial direction. In FIG. 1, the direction to the front-end side of the spark plug 100 corresponds to the +Z-direction, and the direction to the rear-end side of the spark plug 100 corresponds to a −Z-direction. A direction (direction along the Z-axis) parallel to the Z-axis is referred to simply as a "Z-direction". The same is true for the X-axis and the Y-axis.

The spark plug 100 includes an insulator 10, a center electrode 20, a ground electrode 30, and a metal shell 50. At least a part of the outer circumference of the insulator 10 is held by the metal shell 50, which is tubular, and the insulator 10 has an axial hole 12 along the axial line O. The center electrode 20 is disposed in the axial hole 12. The ground electrode 30 is secured to a front-end surface 57 of the metal shell 50 and forms a discharge gap G between the ground electrode 30 and the center electrode 20.

The insulator 10 is a ceramic insulator formed by sintering a ceramic material such as alumina. The insulator 10 is a tubular member having, along the center, the axial hole 12 in which a part of the center electrode 20 is accommodated on the front-end side and a part of a metal terminal 40 is accommodated on the rear-end side. A central trunk portion 19 that has an increased outer diameter is formed at the center of the insulator 10 in the axial direction. A rear-end-side trunk portion 18 is formed nearer than the central trunk portion 19 to the rear-end side. A front-end-side trunk portion 17 having an outer diameter smaller than that of the rear-end-side trunk portion 18 is formed nearer than the central trunk portion 19 to the front-end side. A leg portion 13 the outer diameter of which is smaller than that of the front-end-side trunk portion 17 and gradually decreases in the direction to the front-end side is formed on the front side of the front-end-side trunk portion 17. A facing portion 15 that faces a metal-shell step portion 56 described later is formed at a base end of the leg portion 13.

The metal shell 50 is a cylindrical metal shell that extends in the axial direction and has a tubular hole in which a portion of the insulator 10 extending from a part of the rear-end-side trunk portion 18 to the leg portion 13 is surrounded and held. The metal shell 50 is formed of, for example, low-carbon steel, and a plating process such as nickel plating or zinc plating is performed on the whole thereof. The metal shell 50 includes a tool engagement portion 51, a seal portion 54, and an attaching screw portion 52 in this order from the rear-end side. A tool for installing the spark plug 100 on an engine head is to engage the tool engagement portion 51. The attaching screw portion 52 has a thread ridge that is to be fitted into an attaching screw hole of the engine head. According to the present embodiment, the diameter of the attaching screw portion 52 is 12 mm. The diameter of the attaching screw portion 52 is also referred to as a nominal diameter M. The seal portion 54 is formed in the form of a flange at the root of the attaching screw portion 52. An annular gasket 5 formed of a folded plate is to be interposed between the seal portion 54 and the engine head. The front-end surface 57 of the metal shell 50 is hollow and circular, and the leg portion 13 of the insulator 10 and the center electrode 20 protrude from the center thereof.

A thin crimping portion 53 is disposed nearer than the tool engagement portion 51 of the metal shell 50 to the rear-end side. A compression deformation portion 58, which is thin as in the crimping portion 53, is disposed between the seal portion 54 and the tool engagement portion 51. Annular ring members 6 and 7 are interposed between the inner circumferential surface of the metal shell 50 and the outer circumferential surface of the rear-end-side trunk portion 18 of the insulator 10 from the tool engagement portion 51 to the crimping portion 53. Powder of talc 9 is filled between the ring members 6 and 7. When the spark plug 100 is manufactured, the compression deformation portion 58 is compressively deformed in a manner in which the crimping portion 53 is pressed toward the front-end side so as to be folded inwardly. When the compression deformation portion 58 is compressively deformed, the insulator 10 is pressed toward the front-end side in the metal shell 50 with the ring members 6 and 7 and the talc 9 interposed therebetween. As a result of the press, the talc 9 is compressed in the +Z-direction, and airtightness in the metal shell 50 is increased.

On the inner circumferential side of the metal shell 50, the facing portion 15 located at the base end of the leg portion 13 of the insulator 10 is pressed against the metal-shell step portion 56 that is formed at the attaching screw portion 52 and that extends in the inner circumferential direction with an annular sheet packing 8 interposed therebetween. The sheet packing 8 is a member that maintains airtightness between the metal shell 50 and the insulator 10 and prevents a combustion gas from flowing out.

The center electrode 20 is a rod member in which a core material 22 having thermal conductivity better than that of a center-electrode base material 21 is embedded in the center-electrode base material 21. The center-electrode base material 21 is made of a nickel alloy the main component of which is nickel. The core material 22 is made of copper or an alloy the main component of which is copper.

A flange portion 23 that extends in the outer circumferential direction is formed near a rear-end portion of the center electrode 20. The flange portion 23 is in contact with an axial-hole step portion 14 formed in the axial hole 12 from the rear-end side and is used for positioning of the center electrode 20 in the insulator 10. The center electrode 20 is electrically connected to the metal terminal 40 with a ceramic resistor 3 and a seal body 4 interposed therebetween. The seal body 4 seals the insulator 10 and the center electrode 20.

The center electrode 20 is fixed in the axial hole 12 by using the seal body 4 in the following manner. The center electrode 20 is first inserted into the axial hole 12 from the rear-end side, powder (for example, powder of copper powder and borosilicate glass powder that are mixed in a ratio of 1:1) of the material of the seal body 4 is filled thereon and pressed with a push rod. Subsequently, powder (powder of $ZrO_2$ powder, alumina powder, carbon black, glass powder, and a PVA binder, and so on that are mixed) of the material of the ceramic resistor 3 is filled thereon and pressed with a push rod. Subsequently, powder of the material of the seal body 4 is filled thereon again and pressed with a push rod, and the metal terminal 40 is inserted into the rear end of the axial hole 12. The insulator 10 is heated while the metal terminal 40 is pushed, and the powder of the material of the seal body 4 and the powder of the material of the ceramic resistor 3 in the axial hole 12 are melted and subsequently cooled. Thus, the seal body 4 and the ceramic resistor 3 are solidified in the axial hole 12, and the center electrode 20 is fixed in the axial hole 12. The process of fixing the center electrode 20 in the axial hole 12 by using the seal body 4 is also referred to as a "glass seal process".

The ground electrode 30 is composed of a metal having a high corrosion resistance. Example of the metal having a high corrosion resistance include nickel alloys the main component of which is nickel, such as inconel (registered trademark) 600, or inconel 601. The base end of the ground electrode 30 is welded to the front-end surface 57 of the metal shell 50. According to the present embodiment, an intermediate portion of the ground electrode 30 is bent such that a side surface of the front end portion of the ground electrode 30 faces the center electrode 20. The ground electrode 30 includes, at a front end portion 32, a discharge tip 80 that protrudes toward the center electrode 20, which is the other electrode, and that forms the discharge gap G.

Figure 2:
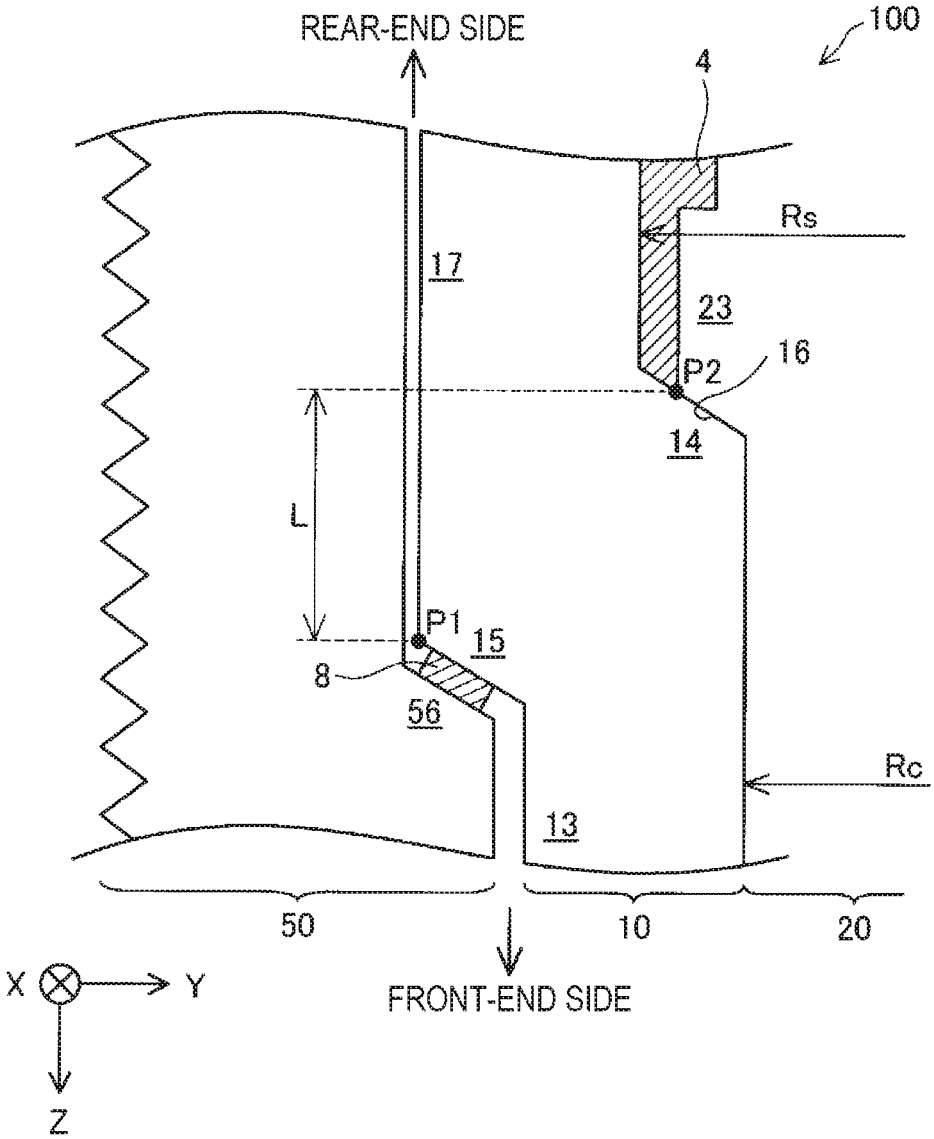
FIG. 2 is an enlarged sectional view of an enlarged portion of the spark plug.

FIG. 2 is an enlarged sectional view of an enlarged portion of the spark plug 100. The section illustrated in FIG. 2 contains the axial line O and is along the axial line O. The facing portion 15 of the insulator 10 is in contact with the metal-shell step portion 56 of the metal shell 50 on the rear-end side with the sheet packing 8 interposed therebetween, as described above. The insulator 10 includes, at the inner circumference thereof, the axial-hole step portion 14 containing a portion (contact portion 16) with which the flange portion 23 of the center electrode 20 is in contact. The flange portion 23 of the center electrode 20 is in contact with the contact portion 16 on the rear-end side.

FIG. 2 illustrates a distance L (mm) along the axial line O from the rear end P1 of the facing portion 15 to the rear end P2 of the contact portion 16. According to the present embodiment, the distance L satisfies the following expression (1).

$$L \leq 1.1 \text{ (mm)} \qquad \text{Expression (1)}$$

FIG. 2 also illustrates that the diameter Rs of the axial hole 12 at which the seal body 4 is disposed and the maximum diameter Rc of the center electrode 20 nearer than the flange portion 23 to the front-end side. The diameter Rs and the diameter Rc are parallel to the Y-direction. According to the present embodiment, it is preferable that the diameter Rs satisfy the following expression (2) and that the diameter Rc satisfy the following expression (3).

$$Rs \leq 3.9 \text{ (mm)} \qquad \text{Expression (2)}$$

$$Rc \leq 2.3 \text{ (mm)} \qquad \text{Expression (3)}$$

The spark plug 100 according to the present embodiment described above satisfies the expression (1) and accordingly can decrease the electrostatic capacity of a region (region having the distance L) extending from a bottom surface on an XY plane containing the rear end P1 of the facing portion 15 to an upper surface on an XY plane containing the rear end P2 of the contact portion 16. Consequently, the erosion of the electrodes of the spark plug 100 can be reduced.

The basis for the structure of the spark plug 100 satisfying the expression (1) will now be described on the basis of the result of an experiment.

A2. Content of Experiment and Result of Experiment

FIG. 3 illustrates the relationship between the distance L and a rate of change in a gap growth amount. The experiment began with manufacture of samples 1 to 7 of the spark plug 100 that had a diameter Rc of 2.3 mm, a diameter Rs of 3.9 mm, and different distances L, samples 8 to 14 thereof that had a diameter Rc of 2.3 mm, a diameter Rs of 3.0 mm, and different distances L, and samples 15 to 21 thereof that had a diameter Rc of 1.9 mm, a diameter Rs of 3.9 mm, different distances L. The nominal diameter M of the spark plug 100 was 12 mm. The experiment was performed under the following conditions. Regarding measurement conditions, the pressure in the atmosphere was 2.6 Mpa, ignition was turned 100 times (100 Hz) per second, and this was continued for 5 hours. The amount of gap growth (gap growth amount (mm)), which is the degree of erosion of the ground electrode and the center electrode, was measured before and after the beginning of the experiment, and the rate of change (%) in the gap growth amount was calculated. The "rate of change (%) in the gap growth amount" indicates the rate of change in the erosion of the electrodes against a conventional product and is calculated by the expression (4) described below. The gap growth amount and the rate of change of the samples are illustrated in FIG. 3 as average values of the result of the experiment in which three samples having the same diameter Rc, diameter Rs, and distance L were manufactured.

$$\{(\text{Gap Growth Amount between Electrodes of Samples/Gap Growth Amount between Electrodes of Conventional Product } (L=1.8 \text{ mm}))-1\}\times 100 \qquad \text{Expression (4)}$$

It can be said that the smaller the gap growth amount after the experiment, the more the erosion of the electrodes is reduced, and that the smaller the rate of change (%), the less the erosion of the electrodes against the conventional product. The column of "DECISION" includes "○" or "x" according to the standard described below. Spark plugs in the case where the column of "DECISION" includes "–" are conventional spark plugs, which are for comparison.

In the case where the rate of change is −5% or more, the column includes x. In the case where the rate of change is less than −5%, the column includes ○.

It can be seen from the result in FIG. 3 that, in the case where the expression (1) holds, the rate of change decreases, and that the erosion of the electrodes is reduced. Specifically, it can be seen from the result in FIG. 3 that the rate of change of the samples 3 to 7, 10 to 14, and 17 to 21, which correspond to the spark plugs satisfying the expression (1), is less than −5%.

Figure 4:
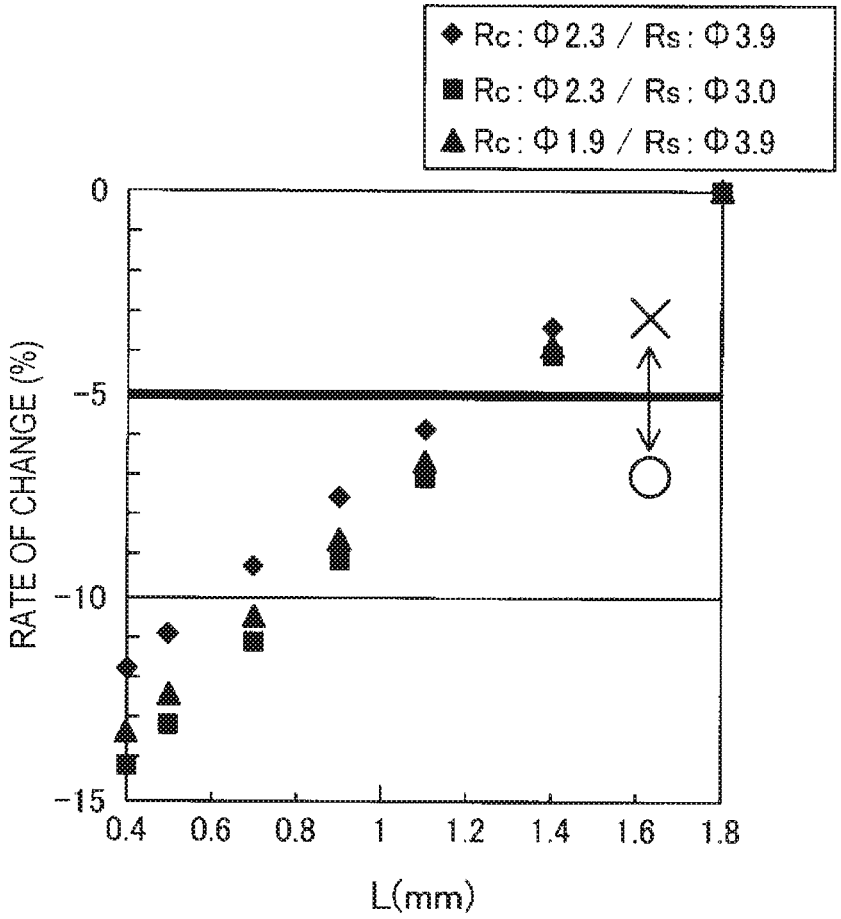
FIG. 4 illustrates the relationship between the distance L and the rate of change.

FIG. 4 illustrates the relationship between the distance L and the rate of change. In FIG. 4, data in the case of a diameter Rc of 2.3 mm and a diameter Rs of 3.9 mm is illustrated by "◆", data in the case of a diameter Rc of 2.3 mm and a diameter Rs of 3.0 mm is illustrated by "■", and data in the case of a diameter Rc of 1.9 mm and a diameter Rs of 3.9 mm is illustrated by "▲".

It can be seen from the result in FIG. 4 that the shorter the distance L, the smaller the rate of change and the more the erosion of the electrodes is reduced, although combination of the values of the diameter Rc and the diameter Rs makes some differences. The above result reveals that the distance L (mm) preferably satisfies the expression (1).

Figure 5:
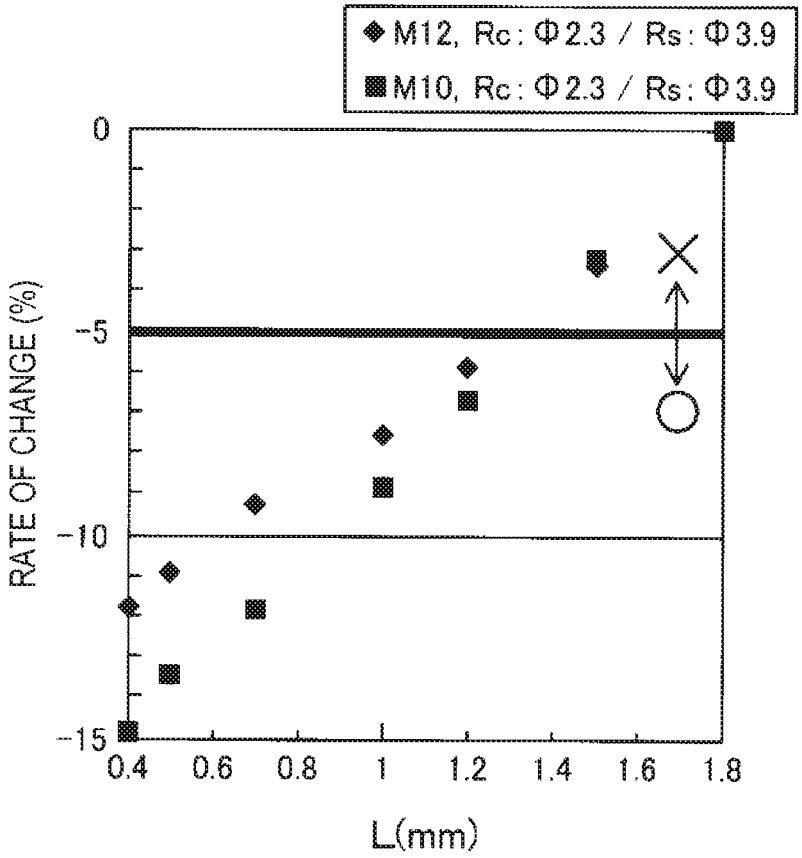
FIG. 5 illustrates the relationship among the distance L, the rate of change, and a nominal diameter M.

FIG. 5 illustrates the relationship among the distance L, the rate of change, and the nominal diameter M. In the experiment, spark plugs having different distances L corresponding to the respective nominal diameters M were manufactured to investigate the relationship between the distance L and the rate of change with respect to the nominal diameters M. The spark plugs each have a diameter Rc of 2.3 mm and a diameter Rs of 3.9 mm. The conditions of the experiment are the same as the conditions used to investigate the relationship between the distance L and the rate of change illustrated in FIG. 3 and FIG. 4.

In FIG. 5, data in the case of a nominal diameter M of 12 mm is illustrated by "◆", and data in the case of a nominal diameter M of 10 mm is illustrated by "■". It can be seen from the result in FIG. 5 that, for the spark plugs having a nominal diameter M of 12 mm or less, the shorter the distance L, the lower the rate of change. It can also be seen that, for the spark plugs having a smaller nominal diameter M, the shorter the distance L, the lower the rate of change, and the erosion of the electrodes is further reduced. The above result reveals that, in the case where the nominal diameter M is 12 mm or less, the distance L (mm) preferably satisfies the expression (1).

A3. Putative Mechanism: A putative mechanism through which the rate of change is improved as a result of the distance L being in the range given by the expression (1) will now be described.

Figure 6:
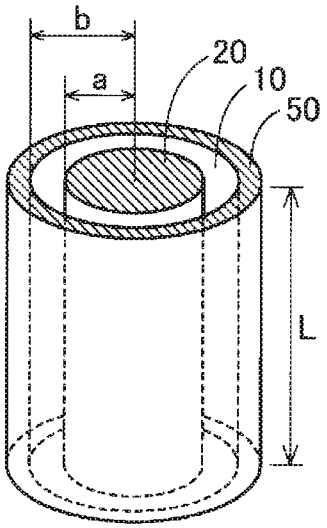
FIG. 6 is a schematic view of the spark plug regarded as a coaxial cylindrical condenser.

FIG. 6 is a schematic view of the spark plug 100 regarded as a coaxial cylindrical condenser. The region having the distance L illustrated in FIG. 2 can be regarded as a coaxial cylindrical condenser (cylindrical condenser) including the center electrode 20 as a central conductor and the metal shell 50 as an outer conductor in FIG. 6. The electrostatic capacity C of the coaxial cylindrical condenser is calculated by the expression (5) described below. In the expression (5), "a" represents the outer radius of the central conductor, "b" represents the inner radius of the outer conductor, L represents the length of the axis, and co represents the dielectric constant of vacuum. For the spark plug 100, "a" corresponds to the outer radius (Rc/2) of the center electrode 20, the distance "b" corresponds to the inner radius of the metal shell 50, and L corresponds to the distance L.

$$C = \frac{2\pi\varepsilon_0 L}{\log\left(\frac{b}{a}\right)} \quad \text{[Math. 5]}$$

As clear from FIG. 5), in the case of the coaxial cylindrical condenser, the shorter the length L of the axis, the lower the electrostatic capacity. That is, in the case of the spark plug 100, the shorter the distance L, the lower the electrostatic capacity. In the spark plug 100 according to the present embodiment, the distance L is in the range given by the expression (1) and relatively short, and accordingly, the electrostatic capacity of the region having the distance L can be decreased.

Figure 7:
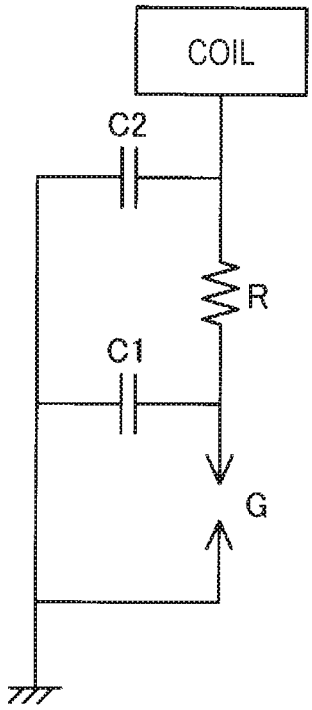
FIG. 7 illustrates an equivalent circuit of the spark plug.

FIG. 7 illustrates an equivalent circuit of the spark plug 100. The spark plug 100 can be regarded as a condenser. A charge stored in the spark plug 100 flows through the gap G during discharge. For this reason, energy (capacitive current) during discharge is decreased in a manner in which the electrostatic capacity of the spark plug 100 is decreased. It can be thought that the erosion of the center electrode 20 and the ground electrode 30 can consequently be reduced. In FIG. 7, a portion nearer than the boundary between the ceramic resistor 3 and the seal body 4 on the front-end side to the front-end side is illustrated as a condenser C1, and a portion nearer than the boundary between the ceramic resistor 3 and the seal body 4 on the front-end side to the rear-end side is illustrated as a condenser C2. In FIG. 7, the internal resistance of the ceramic resistor 3 is illustrated as a resistor R, and a gap between the center electrode 20 and the ground electrode 30 is illustrated as a gap G.

Current flowing from the condenser C2 flows through the resistor R, and the current value greatly decreases. Current flowing from the condenser C1 flows through the gap G without flowing through the resistor R. For this reason, it can be thought that the current flowing from the condenser C1 greatly contributes to the capacitive current created in the gap G during discharge. From the expression (5), the closer the value of "a" and the value of "b" are to each other, the larger the electrostatic capacity. The region of the spark plug 100 having the distance L is thought to be likely to affect the capacitive current more than the other regions because the distance between the inner circumferential surface of the metal shell 50 and the outer circumference of the center electrode 20 is shorter than that of the other regions of the spark plug 100. For this reason, the erosion of the center electrode 20 and the ground electrode 30 can be reduced in a manner in which the electrostatic capacity of the condenser C1 is decreased.

According to the present embodiment, it can be thought that the electrostatic capacity of the condenser C1 can be decreased in a manner in which the distance L is decreased, and that the erosion of the electrodes can consequently be reduced. Although the other performances (for example, anti-pre-ignition, anti-fouling performance, and anti-leak performance) of the spark plug 100 are less affected even in the case where the distance L is decreased, the erosion of the electrodes can be reduced. In addition, the erosion of the electrodes can be reduced without changing the material of the electrodes.

The smaller the nominal diameter M of the spark plug 100, the shorter the distance between the inner circumferential surface of the metal shell 50 and the outer circumference of the center electrode 20, and the larger the electrostatic capacity. However, in the spark plug according to the present embodiment, the distance L is in the range given by the expression (1), and accordingly, the erosion of the electrodes can be reduced in a manner in which the electrostatic capacity of the region having the distance L is decreased, even in the case of the spark plug 100 having a relatively small nominal diameter M of 12 mm or less.

B: Second Embodiment: B1. Structure of Spark Plug

Figure 8:
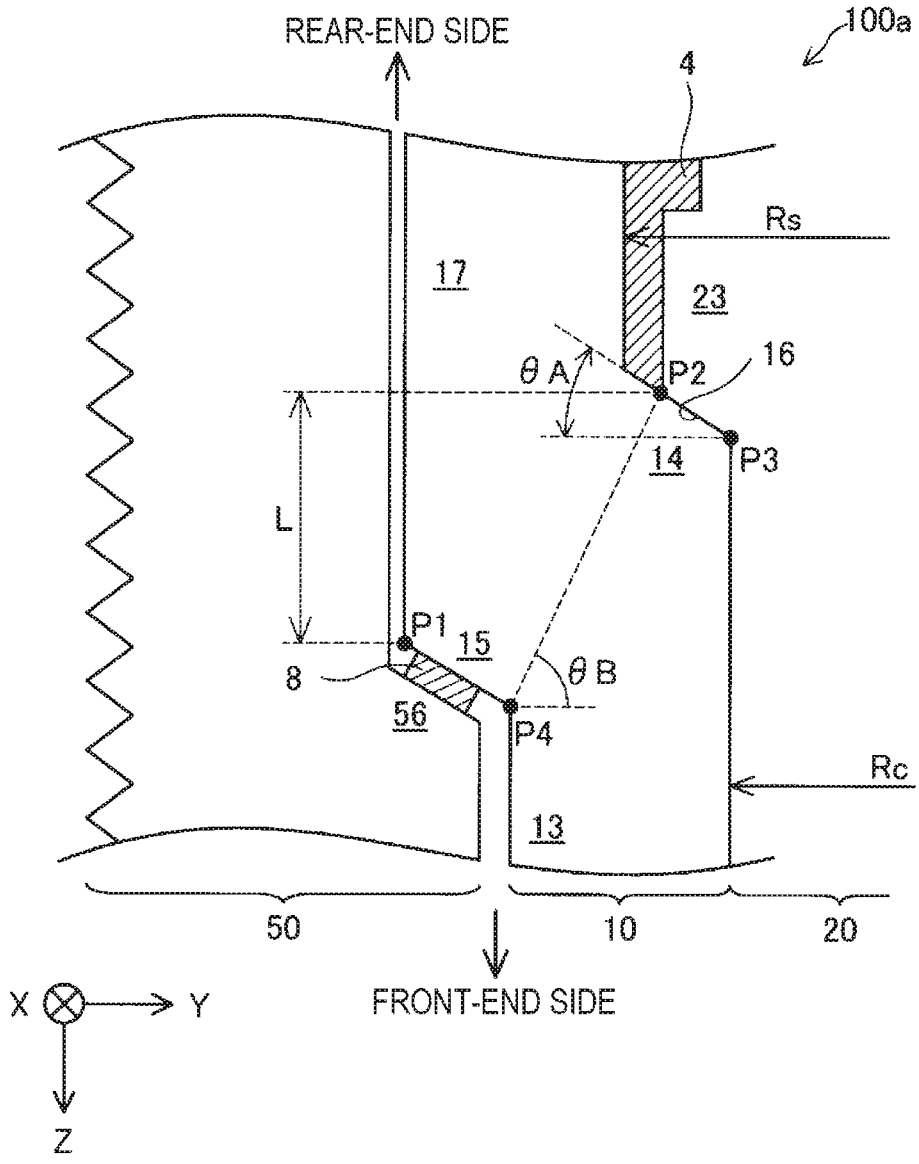
FIG. 8 is an enlarged sectional view of an enlarged portion of a spark plug according to a second embodiment.

FIG. 8 is an enlarged sectional view of an enlarged portion of a spark plug 100*a* according to a second embodiment. The section illustrated in FIG. 8 contains the axial line O and is along the axial line O. In FIG. 8, the distance L, an angle θA, and an angle θB are illustrated. The angle θA is an acute angle formed between a reference line (perpendicular drawn from a front end P3 of the axial-hole step portion 14 to the axial line O) perpendicular to the axial line O and the contact portion 16, which is a portion at which the flange portion 23 of the center electrode 20 is in contact with the insulator 10, in the section. The angle θB is an acute angle formed between a reference line (perpendicular drawn from a front end P4 of the facing portion 15 of the insulator 10 to the axial line O) perpendicular to the axial line O and a straight line connecting the front end P4 of the facing portion 15 and the rear end P2 of the contact portion 16, in the section. The spark plug 100*a* according to the present embodiment not only satisfies the expression (1) but also has the distance L satisfying the expression (6) described below. The sum (θA+θB)(°) of the angle θA and the angle θB satisfies the expression (7) described below. The other structures of the spark plug 100*a* are the same as those of the spark plug 100 according to the first embodiment, and a description thereof is omitted.

$$\theta A + \theta B \geq 90° \quad (6)$$

$$L \geq 0.5 \text{ (mm)} \quad (7)$$

The spark plug 100*a* according to the present embodiment described above satisfies the expression (1) and achieves the same effects as the spark plug 100 according to the first embodiment. In addition, the spark plug 100*a* satisfies the expressions (6) and (7) and can ensure a sufficient strength of the insulator 10 in the glass seal process.

To ensure a sufficient strength of the insulator 10, the value of θA is preferably 20° or more, more preferably 25° or more, further preferably 30° or more.

The basis for the structure of the spark plug 100*a* satisfying not only the expression (1) but also the expressions (6) and (7) will now be described on the basis of the result of an experiment.

B2. Content of Experiment and Result of Experiment: FIG. 9 illustrates the relationship among the distance L, the value of (θA+θB), and the strength of the insulator 10. In the experiment, the insulators 10, the center electrodes 20, and the metal shells 50 were prepared to manufacture the spark plugs 100*a* having different distances L and different values of (θA+θB). The number of samples was 10 for each specification. The insulators 10, the center electrodes 20, and the metal shells 50 were used to perform the glass seal process to fix each center electrode 20 in the axial hole 12 by using the seal body 4. In the glass seal process of the experiment, the presence or absence of damage of each insulator 10 as a result of the seal body 4 penetrating the axial-hole step portion 14 was checked near a portion (contact portion 16) at which the axial-hole step portion 14 and the seal body 4 were in contact with each other. The column of "DECISION" includes "○" or "x" according to the standard described below. In the case where each insulator 10 is not damaged, it can be said that the insulator 10 has a sufficient strength.

In the case where one or more of the 10 samples is damaged, the column includes x. In the case where none of the 10 samples is damaged, the column includes ○.

It can be seen from the result in FIG. 9 that, for samples 36 to 42 having a short distance L of 0.4 mm, the insulators 10 of the samples 40 to 42 having a (θA+θB) value of 100° or more are not damaged. It can be seen that, for samples 22 to 35 having a distance L of 0.5 mm or more, the insulators 10 of the samples 24 to 28 and samples 31 to 35 having a (θA+θB) value of 90° or more are not damaged. The above result reveals that, in the case where the expression (1) holds, the distance L (mm) satisfies the expression (6), and (θA+θB) satisfies the expression (7), the erosion of the electrodes of the spark plug 100*a* is reduced, and a sufficient strength of the insulator 10 is ensured.

B3. Putative Mechanism: A putative mechanism through which a sufficient strength of the insulator 10 is ensured as a result of the distance L and (θA+θB) being in specific ranges will now be described.

Figure 10:
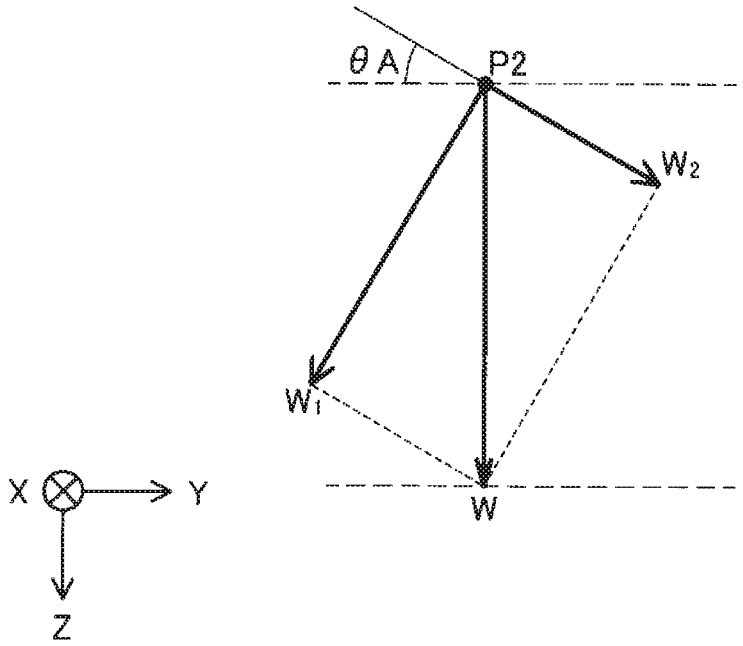
FIG. 10 is a diagram illustrating a force W acting on the insulator in a glass seal process.

FIG. 10 is a diagram illustrating a force W acting on the insulator 10 in the glass seal process. The force W illustrated in FIG. 10 acts on the insulator 10 near the axial-hole step portion 14 in the +Z-direction in the case where powder of the material of the seal body 4 is pressed. A force W1 is a component (W cos θ) of the force W acting in the direction perpendicular to the contact portion 16 of the axial-hole step portion 14. A force W2 is a component (W sin θ) of the force W acting in the direction parallel to the contact portion 16. In the glass seal process, when the powder of the material of the seal body 4 is pressed with the force W, the axial-hole step portion 14 of the insulator 10, particularly the vicinity of the contact portion 16 is pressed with the force W1. At this time, in the case where the distance L is decreased to decrease the electrostatic capacity, the thickness of the insulator 10, which corresponds to the distance from the front end P3 to the front end P4 illustrated in FIG. 8, is decreased, and accordingly, there is a risk of a reduction in the strength of the insulator 10.

Figure 11:
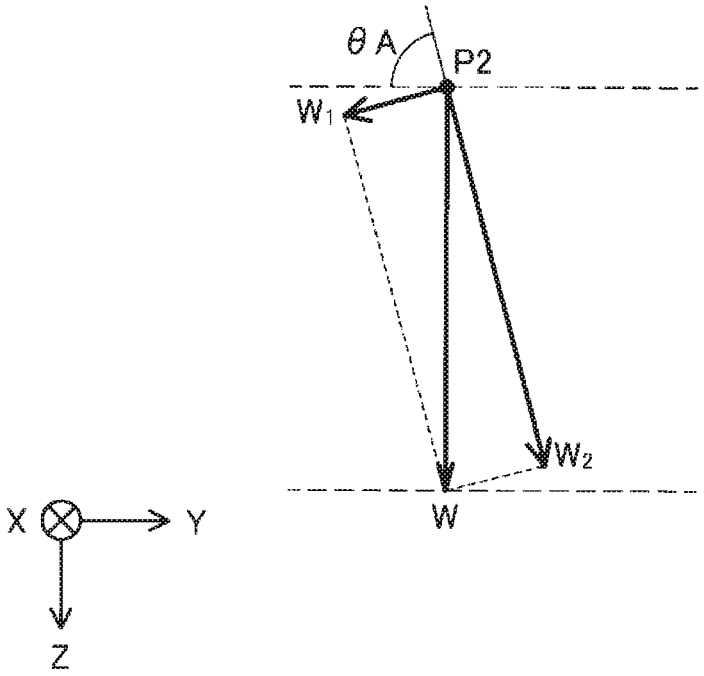
FIG. 11 is another diagram illustrating the force W acting on the insulator in the glass seal process.

FIG. 11 is another diagram illustrating the force W acting on the insulator 10 in the glass seal process. The angle θA illustrated in FIG. 11 is larger than the angle θA illustrated in FIG. 10. In the case where the angle θA is thus increased, the force W1 (W cos θ) acting in the direction perpendicular to the contact portion 16 can be weaker than that in the case where the angle θA is small. Accordingly, a stress applied to the vicinity of the contact portion 16 of the axial-hole step portion 14 is weaker than that in the case where (θA+θB) is not in the range given by the expression (6), that is, in the case where (θA+θB) is less than 90°. From this fact, it can be thought that a sufficient strength of the insulator 10 can be ensured in a manner in which the angle θA is thus changed to adjust (θA+θB) to be in the range given by the expression (6) even when the distance L is decreased to decrease the electrostatic capacity.

The smaller the nominal diameter M, the less the thickness of the insulator 10. For this reason, the spark plug having a relatively small nominal diameter M of 12 mm or less preferably ensures a sufficient strength of the insulator 10. The spark plug 100*a* according to the present embodiment can ensure a sufficient strength of the insulator 10 in a manner in which (θA+θB) is in the range given by the expression (6) even when the nominal diameter M is 12 mm or less.

C. Modification: Although the nominal diameter M is 12 mm or less according to the above embodiments, the nominal diameter M may be larger than 12 mm. Although the spark plugs 100 and 100*a* each include the discharge tip, the spark plugs 100 and 100*a* may not include the discharge tip.

The present invention is not limited to the above embodiments and the modification and can be achieved with various structures without departing from the concept of the present invention. For example, the technical features in the embodiments and the modification corresponding to the technical features in the aspects described in the summary of the invention can be appropriately replaced or combined in order to solve part or all of the above problems or in order to achieve part or all of the above effects. Technical features described as unessential features can be appropriately removed.

REFERENCE SIGNS LIST

C1, C2 . . . condenser
G . . . discharge gap
L . . . distance
O . . . axial line
P1 . . . rear end
P2 . . . rear end
P3 . . . front end
P4 . . . front end
R . . . resistor
Rc . . . seal diameter
Rs . . . center rod diameter
W, W1, W2 . . . force
3 . . . ceramic resistor
4 . . . seal body
5 . . . gasket
6 . . . ring member
8 . . . sheet packing
9 . . . talc
10, 10*a* . . . insulator
12 . . . axial hole
13 . . . leg portion
14 . . . axial-hole step portion
15 . . . facing portion
16 . . . contact portion
17 . . . front-end-side trunk portion
18 . . . rear-end-side trunk portion
19 . . . central trunk portion
20 . . . center electrode
21 . . . center-electrode base material
22 . . . core material
23 . . . flange portion
30 . . . ground electrode

32 . . . front end portion
40 . . . metal terminal
50 . . . metal shell
51 . . . tool engagement portion
52 . . . attaching screw portion
53 . . . crimping portion
54 . . . seal portion
56 . . . metal-shell step portion
57 . . . front-end surface
58 . . . compression deformation portion
80 . . . discharge tip
100, 100*a* . . . spark plug Having described the invention, the following is claimed:

1. A spark plug, comprising:

a tubular metal shell that includes a metal-shell step portion extending in an inner circumferential direction and that has a tubular hole extending in an axial direction;

an insulator that is inserted in the metal shell, that has an axial hole extending in the axial direction, and that includes a facing portion that faces the metal-shell step portion with an annular packing interposed therebetween;

a center electrode that extends in the axial direction, that has a flange portion extending in an outer circumferential direction, and that is inserted in the axial hole such that at least a part of the center electrode protrudes further toward a front-end side of the spark plug than the insulator; and a seal body that is disposed in the axial hole and that seals the insulator and the center electrode, wherein in a section that contains an axial line of the spark plug and that is along the axial line, a distance L along the axial line from a rear end of the facing portion of the insulator to a rear end of a portion at which the flange portion is in contact with the insulator satisfies $$L \leq 1.1 \text{ (mm)}.$$

2. The spark plug according to claim 1, $$\theta A + \theta B \geq 90^\circ \text{ and } L \geq 0.5 \text{ (mm) hold,}$$

where θA represents an acute angle formed between a reference line perpendicular to the axial line and the portion at which the flange portion is in contact with the insulator in the section, and θB represents an acute angle formed between the reference line and a straight line connecting a front end of the facing portion and the rear end of the portion at which the flange portion is in contact with the insulator.

3. The spark plug according to claim 1, wherein a nominal diameter M of a screw portion of the metal shell satisfies $$M \leq 12 \text{ (mm)}.$$

4. The spark plug according to claim 2, wherein a nominal diameter M of a screw portion of the metal shell satisfies $$M \leq 12 \text{ (mm)}.$$

5. The spark plug according to claim 1, wherein a front end surface of the part of the center electrode protrudes forward of a front end surface of the insulator toward the front-end side of the spark plug.

* * * * *